US005329875A

United States Patent [19]

Feuvray

[11] Patent Number: 5,329,875

[45] Date of Patent: Jul. 19, 1994

[54] PORTABLE AND WIND-RESISTANT SIGNALLING DEVICE

[76] Inventor: Beatrice Feuvray, 10, Impasse Monoclair, 71100 Chalon-sur-Saone, France

[21] Appl. No.: 949,540

[22] PCT Filed: May 16, 1991

[86] PCT No.: PCT/FR91/00396

§ 371 Date: Nov. 13, 1992

§ 102(e) Date: Nov. 13, 1992

[87] PCT Pub. No.: WO91/18380

PCT Pub. Date: Nov. 28, 1991

[30] Foreign Application Priority Data

May 16, 1990 [FR] France ..... 90 06334

[51] Int. Cl.[5] ..... G09F 7/22; E01F 9/01

[52] U.S. Cl. ..... 116/63 P; 40/606

[58] Field of Search ..... 116/63 R, 63 P; 40/602, 40/606, 610, 612

[56] References Cited

U.S. PATENT DOCUMENTS 2,192,635 3/1940 Bricker ..... 116/63 P
2,525,728 10/1950 Sauer ..... 116/63 P

FOREIGN PATENT DOCUMENTS 0139858 5/1985 European Pat. Off. ..... 40/606
243345 4/1987 European Pat. Off. .
2609199 12/1986 France .

*Primary Examiner*—William A. Cuchlinski, Jr.
*Assistant Examiner*—W. Morris Worth
*Attorney, Agent, or Firm*—McAulay Fisher Nissen Goldberg & Kiel

[57] ABSTRACT

A signalling device for roads or work sites. The device has a locked position and an unlocked position. In its locked position, when the device is prepared for use, its legs (15) project downwards while its notches (9) surround sections (8) of torsion bars (7, 8). These torsion bars are then raised up along with an indicator panel (1) which temporarily bends when the wind exceeds a certain strength. The device and the panel requires, no ballast and the panel is wind-resistant even on uniform road paving.

19 Claims, 4 Drawing Sheets

PORTABLE AND WIND-RESISTANT SIGNALLING DEVICE

BACKGROUND OF THE INVENTION

1. Field of the Invention

The present invention relates to both a portable and wind-resistant signalling device, comprising an indiator panel. Such a device is provided to be placed on the ground and it may be used for bearing an indicator panel of any type. In particular, it may be a question of a panel for road signalling, industrial or commercial advertising, signalling on a worksite, etc...

2. Description of the Prior Art

To that end, it is already known to use an underframe bearing the indicator panel, as described for example in Patent FR-A-2 609 199. However, it is ascertained that such a known apparatus presents various drawbacks in use. In particular, the underframe being constituted by a foldable trestle, it lacks rigidity and is no longer suitable for indicator panels of large dimensions, of the type now used in particular on motorways. Under the effect of a strong wind, or even upon simple passage of fast-moving vehicles close by, it is ascertained that the whole of the apparatus tends to advance in small successive jumps. In fact, it remains necessary to ballast the apparatus as soon as the dimensions of the indicator panel become large.

SUMMARY OF THE INVENTION

The present invention has for its object to avoid these drawbacks by providing a signalling device which is at the same time light, foldable and usable without ballast, whilst, in fact, it presents a perfect stability when it is placed on any terrain, and even on the carriageway of a motorway, even if the panel which it supports is of large dimensions.

To that end, this signalling device comprising an indicator panel whose lower part is supported and mounted to pivot, about a transverse axis, by a support assembly with elastic return by means of at least one torsion bar, is characterized in that it comprises a rigid base frame bearing the indicator panel and a locking device is provided to immobilize the support assembly with elastic return in the position where the panel is raised, substantially vertically, or to unlock it when the panel must be folded down in the plane of the base.

BRIEF DESCRIPTION OF THE DRAWINGS

Various embodiments of the present invention will be described hereinafter by way of non-limiting examples, with reference to the accompanying drawings, in which.

DESCRIPTION OF THE PREFERRED EMBODIMENTS

Figure 1:
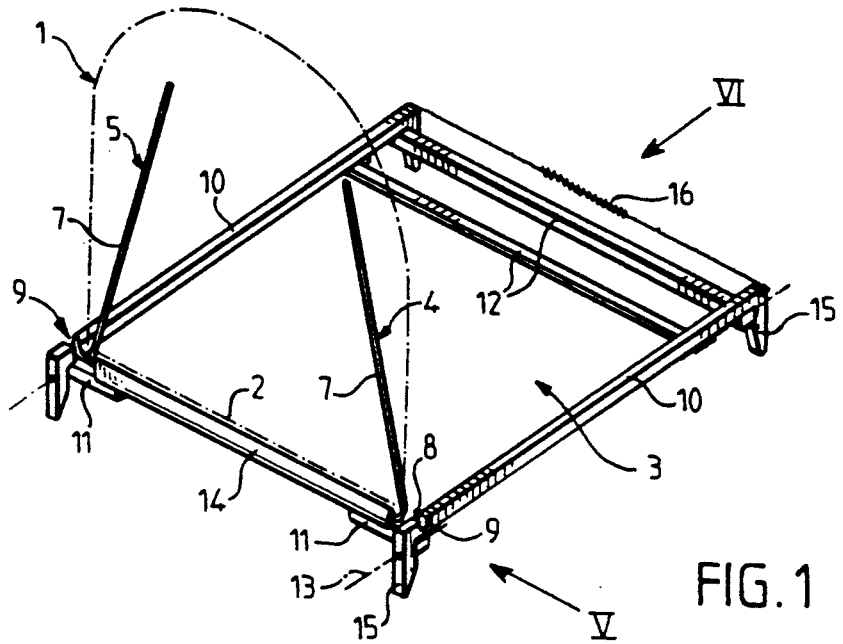
FIG. 1 is a view in perspective of a signalling device according to the invention, when it is in opened out position.
Figure 2:
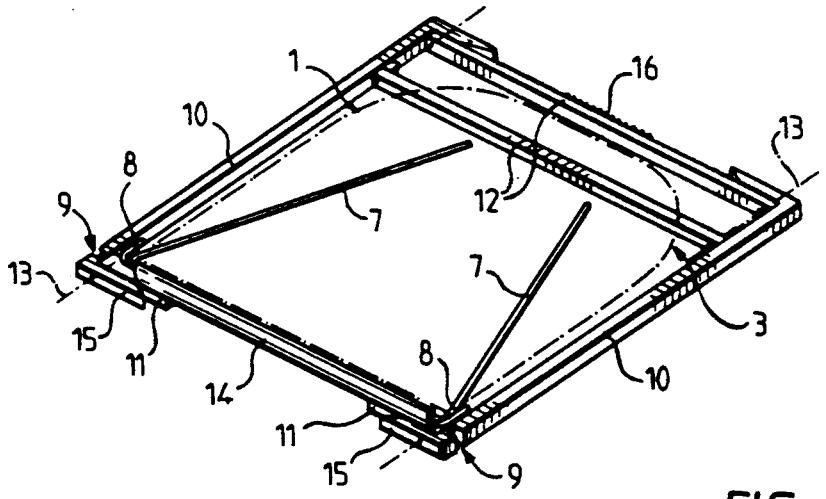
FIG. 2 is a view in perspective of the same device, in folded down position.
Figure 3:
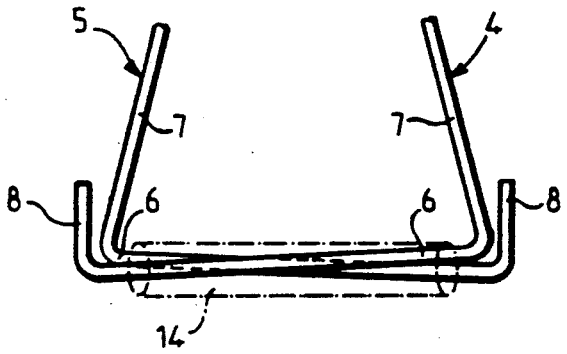
FIG. 3 is a view in elevation, on a larger scale, of the elastic return mechanism with two torsion bars.

FIGS. 1 and 2 represent a signalling device according to the invention, comprising an indicator panel 1 (shown in dashed and dotted lines), of which the substantially horizontal lower part 2 is mounted to pivot about a transverse axis, on the front of a horizontal frame 3 serving as base. Articulation is ensured by two torsion bars 4 and 5. Each of these bars comprises a central torsion segment 6, substantially horizontal, materializing the axis of articulation of the panel, this central segment 6 extending between a first end portion 7, bent and rigidly fast with the indicator panel 1, and a second end portion 8, bent on the same side as the first end portion 7 and capable of being engaged in a notch 9 in the locking device when the latter is in locked position, in order to maintain the panel 1 vertically opened out (FIGS. 1, 3 and 4).

The two notches 9 receiving the second bent end portions 8 are respectively formed in two longitudinal members 10 forming part of the base frame 3. Each longitudinal member 10 is articulated on front 11 and rear 12 cross pieces of the base frame 3, in order to be able to pivot about a horizontal longitudinal axis 13.

The two central torsion segments 6 of the two torsion bars 4 and 5 are disposed side by side, preferably inside a rigid tube 14, fast with the front crosspiece 11 and which maintains them against one another.

Figure 4:
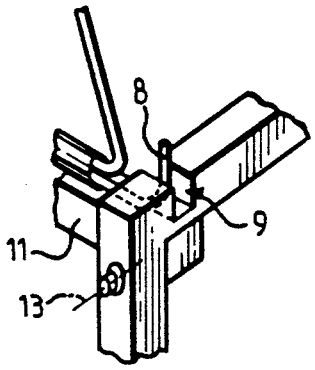
FIG. 4 is a view in perspective, on a larger scale, showing part of the device for locking one of the torsion bars.
Figure 5:
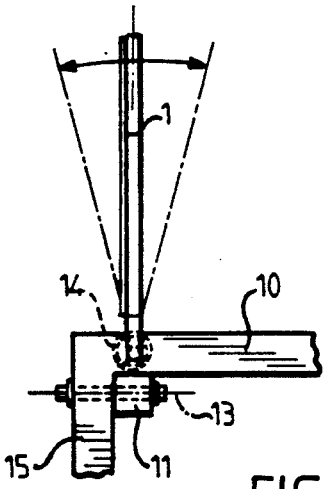
FIG. 5 is a partial elevational view in the direction of arrow V of FIG. 1.

In the mode of construction of FIGS. 1 to 5, each of the two longitudinal members 10 is off-centered with respect to its pivot axis 13. In this way, the locking notch 9 may be brought into a first position in which it is upwardly open and receives the corresponding second portion 8, in that case extending upwardly, of one of the torsion bars 4, 5 in order to immobilize the first portions 7 in rotation, thus maintaining the panel 1 folded out, i.e. in substantially vertical position (FIGS. 1, 4 and 5).

Notch 9 may also be brought, after a pivoting of the associated longitudinal member through 90° towards the outside, into a second position in which it extends horizontally and opens towards the outside so as to release the second portion 8 (FIG. 2), which then makes it possible to fold the panel 1 and the first portions 7 down into the plane of the base frame 3.

Each of the longitudinal members 10 bears, at each of its ends, a foot for bearing onto the ground which retracts into the plane of the frame 3 when the assembly is in its folded position (FIG. 2) or which projects vertically downwardly (FIGS. 1, 4 and 5), thus being perpendicular to the base frame 3, when the assembly is in its folded out position.

In this latter case, the feet 15 form four spikes which hook firmly onto the ground, without it being necessary to increase the weight of the assembly by placing ballast onto the base frame 3.

In order to maintain in place the feet 15 and longitudinal members 10 both in the folded out position (FIG. 1) and in the folded down position (FIG. 2), there is provided an elastic return mechanism with kinematics with exceeding of the neutral point. In the case of FIGS. 1 to 6, this mechanism comprises, to the rear, a substantially horizontal return spring 16 of which each of the ends is anchored on a rear foot 15, at a point 17 which is located both outside the interval defined by the pivot axes 13 and above the horizontal plane defined by these two axes, when the feet 15 extend downwardly.

Figure 6:
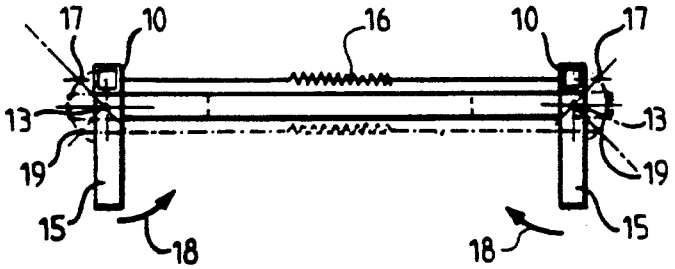
FIG. 6 is a view in elevation in the direction of arrow VI of FIG. 1, illustrating the elastic return mechanism with exceeding of neutral point, provided to immobilize the longitudinal locking members.

It is seen that, if the feet 15 are folded down into their folded position (FIG. 6, arrows 18), the two points of anchoring pass from position 17 to a position 19 which, this time, is located below the horizontal plane of axes 13. It will be understood that, between these two positions 17 and 19, the points of anchoring pass through a neutral point or position of unstable equilibrium, when they ace spaced apart from one another at a maximum, in the same horizontal plane as axes 13. The two positions 17 and 19 in FIG. 6 are therefore both positions of stable equilibrium corresponding respectively to folded out panel 1 (FIG. 1) and to this same panel folded down (FIG. 2).

Figure 7:
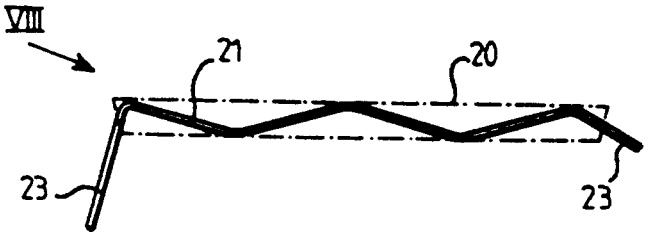
FIG. 7 schematically illustrates a variant embodiment comprising a tubular longitudinal member of square section traversed by a spring wire in zig-zag.
Figure 8:
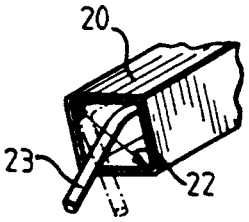
FIGS. 8 and 9 are partial views in perspective in the direction of arrow VIII of FIG. 7, when the spring wire is located respectively in one and the other of the two possible diagonal positions.
Figure 9:
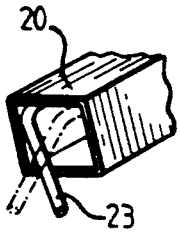

In the variant embodiment illustrated in FIGS. 7, 8 and 9, this locking device with elastic return has been replaced by two fixed tubular longitudinal members 20, of square cross section. Inside each of these tubes is disposed a metal spring wire 21, shaped as a plane zig-zag profile. This zig-zag wire naturally corresponds to dimensions in width 22 substantially equal to the dimensions of the diagonals of the inner square of the longitudinal member 20. In other words, the naturally plane form of the zig-zag wire 21 gives the latter two possible positions of equilibrium, in the longitudinal member 20, namely one in each of the diagonal planes of this longitudinal member. This elastic wire 21 may be passed from one to the other of the diagonal planes, forcing it by acting on its outer ends 23, folded so as to constitute the equivalent of said feet 15. In other words, each foot 15 or 23 constitutes, in folded out position, both a foot which hooks the assembly into the ground in the manner of a spike (FIG. 1), and a handle which the user uses to fold the panel out or down.

Figure 10:
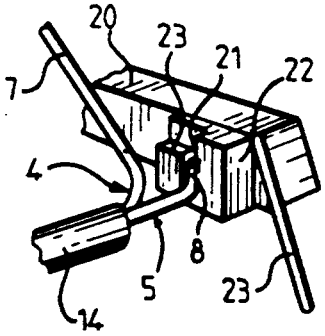
FIGS. 10 and 11 are partial views in pespective illustrating a variant embodiment of the device for locking the torsion bars, respectively in position of locking and of unlocking, used with the variant embodiment shown in FIGS. 7 to 9.
Figure 11:
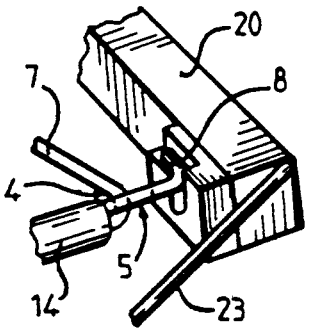

FIGS. 10 and 11 represent a locking device which is provided in the case of the signalling device comprising fixed tubular longitudinal members 20 as shown in FIGS. 7 to 9. In that case, the second portion 8 of each torsion bar 4, 5 is engaged, in locking position, in a vertical notch 21*a*, upwardly open, formed in the inner face of a locking block 22 fixed to the inner face of the longitudinal member 20. The upper part of the notch 21*a* communicates with a horizontal recess 23 formed in the inner face of the locking block 22. Consequently, when the second portion 8 is housed in the bottom or the lower part of the notch 21*a* (FIG. 10), it is immobilized in rotation, which ensures locking of the corresponding torsion bar. In order to unlock this bar (FIG. 11), it suffices to raise it, so as to bring it to the level of the recess 23, after which the second portion 8 is released and the indicator panel may then be folded down into the plane of the base frame.

Figure 12:
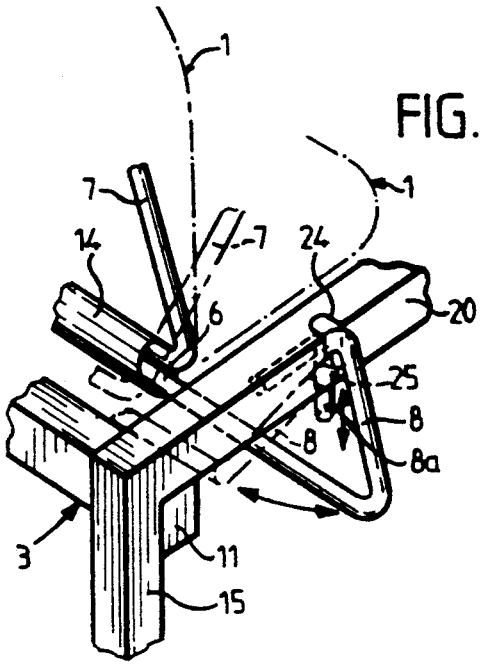
FIG. 12 is a partial view in perspective of another variant embodiment o[the locking device.
Figure 13:
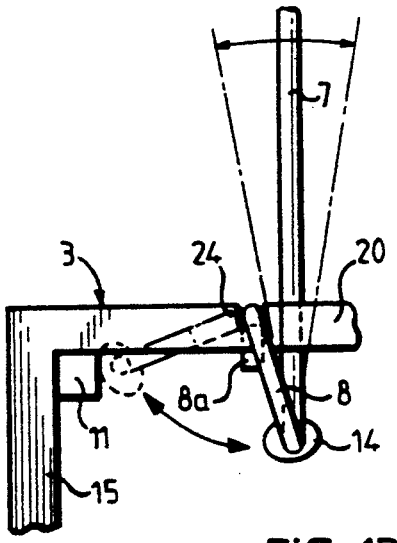
FIG. 13 is a view in elevation of the locking device shown in FIG. 12.
Figure 14:
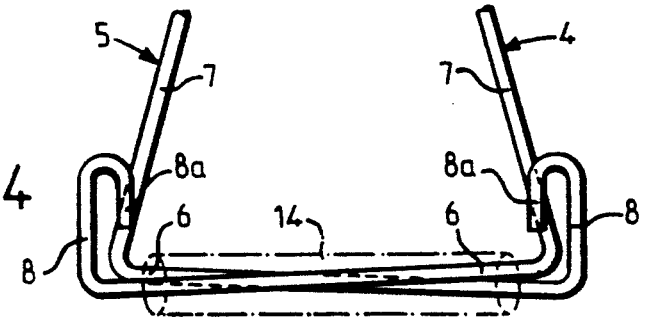
FIG. 14 is a view in elevation of the torsion bars used with the locking device of FIGS. 12 and 13.

FIGS. 12 to 14 represent another variant embodiment of the locking device. In that case, the second portion 8 of each torsion bar 4, 5 is folded onto itself inwardly, forming a hook and terminating in a short end branch 8*a* parallel to the second portion 8. Furthermore, the base frame 3 comprises fixed tubular longitudinal members 20 of square cross section and the upper horizontal face and the outer vertical face of each longitudinal member 20 are pierced with a common notch 24. In addition, the lower horizontal face of the longitudinal member 20 is pierced with a hole 25 vertically aligned with that part of the notch 24 formed in the upper horizontal face. In position of locking, as shown in solid lines in FIGS. 12 and 13, the vertical end branch 8*a* extending the second portion 8 is vertically engaged through the upper notch 24 and the lower hole 25, whilst the second portion 8 extends downwardly outside the longitudinal member 20. The corresponding torsion bar is thus immobilized in rotation. In order to unlock this bar, it suffices to raise the second portion 8 and the end branch 8*a* slightly so that the lower end of the latter is totally retracted inside the longitudinal member 20 and disengaged above the hole 25, which has for its effect to release the torsion bar, and then to tip this bar so as to pivot it upwardly, inside the tubular longitudinal member 20, the end branch 8*a* which then occupies a substantially horizontal position is shown in dashed lines in FIGS. 12 and 13.

In this embodiment, the transverse tube 14 which is traversed by the central segments 6 of the two torsion bars 4, 5, is free and it may move between the lower position shown in solid lines and the upper position shown in dashed lines in FIG. 13.

Figure 15:
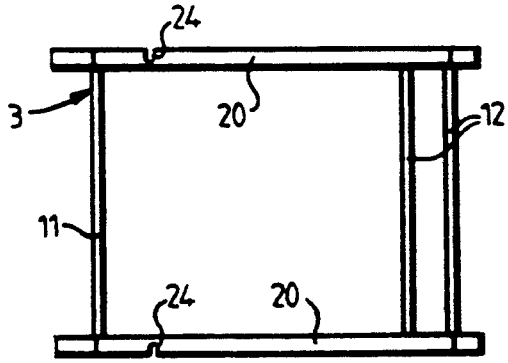
FIG. 15 is a plan view of a stackable base frame.
Figure 16:
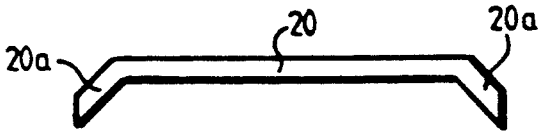
FIG. 16 is a view in elevation of the base frame of FIG. 15.

FIGS. 15 and 16 represent a base frame 3 which may be used for the signalling device according to the invention. In that case, the two fixed longitudinal members 20 comprise a horizontal central part extended, at its two ends, by end parts 20*a* which constitute feet inclined, for example at 45°, downwardly towards the outside of the frame 3, so that the signalling devices may be stacked. The two longitudinal members 20 are connected by front (11) and rear (12) crosspieces, crosspiece 11 serving for hooking to a trestle.

It is seen that the device according to the invention presents numerous advantages. In particular, there is no longer need to use ballast and when the wind is blowing, or due to the displacements of air resulting from the traffic movement, the signalling panel 1 inclines more or less, against the return action of the torsion bars 4 and 5, which reduces accordingly the thrust which tends to displace the base 3 over the ground. The pivot axis 2, materialized by torsion bars 4, 5, is located in the lower part of the panel 1. The base 3, constituted by a closed frame, is particularly rigid and stable. Finally, when the assembly in folded out position is placed, even on a motorway road coating, it does not tend to advance little by little under the effect of the displacements of air, and this despite its low weight, which facilitates manipulation thereof.

I claim:

1. A signalling device comprising:

a rigid base frame (3);

an indicator panel (1) having a lower part (2) pivotally mounted on a support assembly for pivotal movement about a transverse axis, said support assembly bearing on said base frame (3);

said support assembly comprising two torsion bars (4, 5), each of said torsion bars including a central torsion segment (6) placed substantially horizontally relative to said rigid base frame (3) and said indicator panel (1), a first bent end portion (7) fast with said indicator panel 1); and a locking device for immobilizing said support assembly in a locked position at which said panel (1) is raised to a folded out position, substantially vertical relative to said rigid base frame and locking said panel relative to said base frame, and for unlocking said panel relative to said base frame, and for unlocking said panel relative to said base frame (3) when said panel (1) must be folded down into a folded down and unlocked position in the plane of said base frame (3);

each of said torsion bars including a second bent end portion (8) for engagement with a locking notch (9, 21*a*, 24) in said locking device, when said indicator panel (1) is in said folded out position, and being releasable when said locking notch (9, 21*a*, 24) is moved to release said second bent end portion (8) and said indicator panel (1) is unlocked, for folding said panel (1) into said folded down position.

2. The device according to claim 1, including at least one longitudinal member (10, 20) mounted to pivot about a longitudinal axis (13) on said base frame (3), and said locking notch (9) being cut out in said longitudinal member.

3. The device according to claim 1, including two longitudinal members (10, 20) mounted to pivot about a longitudinal axis (13) on said base frame and a foot (15) for abutment onto the ground for each of said two pivoting longitudinal members (10, 20) at each of their ends, and said feet (15) extending downwardly in a folded out position.

4. The device according to claim 3, wherein each said longitudinal member (10) is off-centered with respect to its longitudinal pivot axis (13) and corresponding ends of each of said two pivoting longitudinal members (10) are connected together by a return spring mechanism (16) with kinematics exceeding a neutral point about each said pivot axis (13) of each said longitudinal member (10), so that, for each said longitudinal member (10), two positions of stable equilibrium are defined on either side of said neutral point, one of said two positions being a first position of said longitudinal member (10) in which said corresponding torsion bar (4, 5) is unlocked for folding said panel (1) down, and the other of said two positions being a second position in which said notch (9) of the longitudinal member (10) locks the corresponding torsion bar (4, 5) in said folded out position.

5. The device according to claim 3, wherein there are two longitudinal members (20), each longitudinal member (20) comprising a metal tube of square section, rigidly fast with said base frame (3), and including a metal spring wire disposed inside said tubular longitudinal member (20), said tubular longitudinal member (20) having two longitudinal diagonal planes, said wire having a zig-zag configuration and having two positions of equilibrium in one or the other of said two longitudinal diagonal planes, said metal spring wire (21) being of said zig-zag configuration which may be passed by force, by elastic deformation, from one of said diagonal plane positions to the other of said diagonal plane positions of locking and unlocking corresponding respectively to said one and the said other of said two diagonal planes, and said wire (21) having bent ends (23) projecting from said tubular longitudinal member (20) and constituting both corresponding retractable feet of said base frame (3) and control handles for passing said metal spring wire from said locked position to said unlocked position.

6. The device according to claim 1, wherein there are two longitudinal members (20), each longitudinal member (20) comprising a metal tube rigidly fast with said base frame (3), and including a metal spring wire (21) disposed inside said tubular longitudinal member (20), said longitudinal member (20) having two longitudinal diagonal planes, said metal spring wire (21) having a zig-zag configuration and being disposed in at least one of said two longitudinal diagonal planes, said metal spring wire (21) requiring forcible movement from said locked position to said unlocked position corresponding respectively to said one and the said other of said two diagonal planes, and said wire (21) having bent ends (23) projecting from said tubular longitudinal member (20) and constituting both corresponding retractable feet of said base frame (3) and control handles for passing said metal spring wire from said locked position to said unlocked position.

7. The device according to claim 5, wherein each said longitudinal member (20) includes, on its inner face, one of said locking notches in the form of a locking unit (22) having in its inner face a vertical notch (21*a*), opening upwardly and a horizontal recess (23), the upper part of said vertical notch (21*a*) communicating with said horizontal recess (23) and the lower part of said vertical notch (21*a*) receiving the second end portion (8) of said torsion bar to immobilize said torsion bar for ensuring locking of said torsion bar, whilst said upper recess (23) allows release of said second end portion (8) upon raising of said torsion bar.

8. The device according to claim 6, wherein each said longitudinal member (20) includes one of said locking notches in the form of a locking units (22) having a vertical notch (21*a*), opening upwardly and a horizontal recess (21*a*) communicating in its upper part, the lower part of said vertical notch (21*a*) receiving the second end portion (8) of said torsion bar to immobilize it in said locking position, and said upper recess (23) allowing release of said second end portion (8).

9. The device of claim 11, including a fixed longitudinal member (20) and a notch (24) in the upper face and in the outer vertical face thereof, said fixed longitudinal member (20) having a lower face pierced with a hole (25) aligned vertically with said notch (24), said second bent end portion (8) being folded onto itself in the form of a hook and comprising an end branch 98*a*) for vertical engagement through said locking notch (24) and said hole (25) in the locked position thereof and for housing freely inside said longitudinal member (20) in the unlocked position.

10. The device of claim 11, wherein each said locking notch (24) is formed in an upper face and in an outer vertical face of a fixed longitudinal member (20), the lower face of said fixed longitudinal member (20) being pierced with a hole (25) aligned vertically with said locking notch (24), and said second portion (8) is folded onto itself in the form of a hook and including an end branch (8*a*) for vertical engagement through said locking notch (24) and said hole (25) in said locked position and for being housed freely inside said longitudinal member (20) in said unlocked position.

11. The device of claim 10, wherein said notch (24) is on an upper part of said longitudinal member and said hole (25) is through a lower part of said longitudinal member.

12. The device of claim 9, wherein said notch (24) is on an upper part of said longitudinal member and said hole (25) is through a lower part of said longitudinal member.

13. The device according to claim 1, wherein said base frame (3) comprises two longitudinal members (20), each of said longitudinal members including a horizontal central part extended, at its two ends, by end parts (20*a*) forming feet downwardly inclined towards the outside of said frame (3), so that signalling devices may be stacked.

14. The device according to claim 2, wherein said two longitudinal members (20 each includes a horizontal central part and extended at its two ends by end parts (20*a*) inclined downwardly and towards the outside of said frame (3) to permit stacking of signalling devices.

15. The device of claim 14 wherein said end parts (20*a*) are inclined downwardly at an angle of 45°.

16. The device of claim 14, wherein said end parts (20*a*) form inclined feet.

17. The device of claim 16, wherein said end parts (20*a*) are inclined downwardly at an angle of 45°.

18. The device of claim 1, wherein said bent end portions (7, 8) are inclined downwardly.

19. The device of claim 5, wherein said bend ends (23) are inclined downwardly.

* * * * *